United States Patent [19]

Shenoy et al.

[11] Patent Number: 4,637,216

[45] Date of Patent: Jan. 20, 1987

[54] METHOD OF RELIQUEFYING CRYOGENIC GAS BOILOFF FROM HEAT LOSS IN STORAGE OR TRANSFER SYSTEM

[75] Inventors: Thirthahalli A. Shenoy, Whitehall; Arthur R. Winters, Jr., Coopersburg, both of Pa.

[73] Assignee: Air Products and Chemicals, Inc., Allentown, Pa.

[21] Appl. No.: 823,161

[22] Filed: Jan. 27, 1986

[51] Int. Cl.[4] ..... F17C 13/00

[52] U.S. Cl. ..... 62/54; 62/116; 62/500

[58] Field of Search ..... 62/54, 116, 500

[56] References Cited

U.S. PATENT DOCUMENTS

| | | | |
|---|---|---|---|
| 3,271,965 | 9/1966 | Maher et al. | 62/54 |
| 3,733,838 | 5/1973 | Delahunty | 62/54 |
| 3,828,564 | 8/1974 | Spies et al. | 62/9 |
| 3,932,158 | 1/1976 | Hildebrandt | 62/500 |
| 4,169,361 | 10/1979 | Baldus | 62/402 |
| 4,267,701 | 5/1981 | Toscano | 62/86 |
| 4,498,313 | 2/1985 | Hosoyama et al. | 62/514 R |

*Primary Examiner*—Ronald C. Capossela

*Attorney, Agent, or Firm*—Willard Jones, II; James C. Simmons; E. Eugene Innis

[57] ABSTRACT

The invention is a method of returning process generated warm vapors of a cryogen such as hydrogen, helium and neon, to the main liquefier by contacting the warm vapors with process liquefied cryogen in order to generate saturated, essentially constant enthalpy vapors that can be readily processed by the main liquefier. Three example methods are described. In the first two methods, the warm vapor is recycled through the main storage tank associated with the process back to the main liquefier. In the third method, the warm vapor is washed with liquid in a contactor before being recycled to the main liquefier.

10 Claims, 4 Drawing Figures

METHOD OF RELIQUEFYING CRYOGENIC GAS BOILOFF FROM HEAT LOSS IN STORAGE OR TRANSFER SYSTEM

FIELD OF THE INVENTION

The present invention is directed to a process for the liquefaction of a cryogen such as hydrogen, helium and neon. More specifically, the invention is directed to a method for the recycle to the main liquefier of warm vapors generated due to heat leak in the storage or transfer system.

BACKGROUND OF THE INVENTION

Several processes have been disclosed for the liquefaction of cryogens such as helium.

In U.S. Pat. No. 3,828,564, a process for liquefaction of a cryogen such as helium is disclosed. This process comprises cooling and liquefying said gas by indirect heat exchange with a separate refrigerant circulating in a closed refrigeration cycle. The heat exchange is conducted with the refrigerant from a single refrigerant cycle, said refrigerant being subjected to both engine expansion and at least partially isenthalpic expansion, whereby the refrigerant is cooled sufficiently to effect liquefaction of all the cryogen in a single pass, thereby avoiding the necessity of additional compressor or purification capacity for recycled gas.

In U.S. Pat. No. 3,932,158, an object is cooled by a collant operating with a single or multi-stage coolant cycle in which the coolant, in the last stage, is partially expanded, cooled in a separator-evaporator and fed to the object to be cooled. At least a portion of the coolant fluid, following passage through the object, is expanded through a throttle to form a liquid-gas phase mixture which is separated in the separator-evaporator, the gas phase being recirculated. The expansion of the coolant fluid prior to entry into contact with the object is carried out according to the patent in one or more ejectors whose suction side or sides draws a portion of the cooling fluid from part of the cycle elsewhere into the stream fed to the object to increase the mass flow.

In U.S. Pat. No. 4,169,361, refrigeration is produced by compressing a refrigerant and expanding the refrigerant isentropically in a nozzle. At least a part of the expanded refrigerant is passed in indirect heat exchanging relationship with the portion of the refrigerant prior to expansion. An expansion engine can be used to work-expand a portion of the compressed refrigerant with the expanded gas returned to the compressor. The balance of the compressed stream is expanded in the nozzle.

In U.S. Pat. No. 4,267,701, a helium liquefaction plant is disclosed, wherein a compressor includes first, second and third stages and a precooling section includes first, second and third turboexpanders in series between high and low pressure lines of a heat exchanger. A portion of the medium pressure gas at the output of the second turboexpander is directed back through the heat exchanger and mixed with the output of the first compressor stage. The third turboexpander is positioned between the medium and low pressure lines.

In U.S. Pat. No. 4,498,313, a helium gas-refrigerating and liquefying apparatus is disclosed, which comprises: a neon gas-refrigerating and liquefying circuit which precools helium gas and comprises a turbo type compressor, heat exchangers, turbo type expansion machines and a Joule-Thomson valve and a helium gas-refrigerating and liquefying circuit which comprises a turbo type compressor, heat exchangers, an expansion turbine and a Joule-Thomson valve, the former circuit system being constructed to associate with the latter circuit system so as to further cool the precooled helium gas in the latter circuit system by heat exchange therewith.

None of the aforementioned processes disclose how to handle the problem of recycling warm vapors to the main liquefier, which are generated by the process and during the loading of product. Two solutions to this problem have been known and used in commercial practice. One method was to eliminate the generation of warm vapors and the other method was to reliquefy the warm vapors.

The first method, tried with only partial success, was to circulate helium, cooled by liquid nitrogen, through product trailers. Unfortunately, many of these trailers are effectively partitioned lengthwise by several transverse anti-slosh baffles. In some instances the vapor vent line of the trailer is in the front of the inner tank, some in the middle, and some in the rear. In the latter case, the circulating helium effectively by-passed most of the inner tank, and the tank could never cool to circulate temperature.

The second method and present standard practice is the installation of a reliquefier. The warm helium vapors are returned to a reliquefier unit which contains a series of heat exchangers and compression and expansion equipment. About 80–90%, of the warm vapors are reliquefied and returned to the storage tank; the balance of the warm helium vapor is transferred at ambient conditions to the main liquefier unit.

The reliquefier can also be used to make the liquefier independent of the tank by operating the reliquefier to process tank vapors, in addition to the warm vapors generated by heat leak, which would normally be sent back to the liquefier.

Despite the advances made in the art, the art as represented above has failed to disclose an efficient method for recycle of warm vapors back to the main liquefier.

BRIEF SUMMARY OF THE INVENTION

The present invention is directed to a process for the liquefaction of a cryogen, such as hydrogen, helium, and neon, of the type wherein warm vapors of said cryogen generated by the process and product loading are recycled to the liquefier, the improvement comprising: contacting the warm vapors (vapors which are superheated and at a pressure in the range of 10–25 psia) of said cryogen with said liquid cryogen, to produce a saturated, essentially constant enthalpy vapor stream; and recycling said saturated, essentially constant enthalpy vapor stream back to the liquefier.

DETAILED DESCRIPTION OF THE INVENTION

The present invention is a method for the recycle of warm vapors of a cryogen, generated due to heat leak in the storage and transfer system and vapors displaced during liquid trailer filling, to the main liquefier of a cryogenic liquefaction plant. By warm vapors, it is meant a vapor which is superheated and at a pressure in the range of 10–25 psia. The present invention is useful for cryogens such as hydrogen, helium and neon, and is especially suited for recycle of warm helium vapor to the main helium liquefier.

The key aspect of the present invention is the contacting of these warm vapors with liquefied cryogen so that a saturated, essentially constant enthalpy vapor stream is produced for recycle to the main liquefier. By essentially constant enthalpy vapor, it is meant that the enthalpy of the vapor will not vary by more than four percent (4%), to the plus or minus, of the latent heat of vaporization of the cryogen being liquefied as measured at atmospheric pressure, with a change in the temperature and pressure of the vapor.

The contacting required in the present invention between the warm cryogenic vapors and the process generate liquid cryogen can be accomplished in several ways. To enumerate some of these ways, three embodiments of the present invention follow. To better understand these embodiments and the differences between these and the prior art, a brief description of the prior art method follows first. Both the prior art and the embodiments which follow use helium as the cryogen.

PRIOR ART

Figure 1:
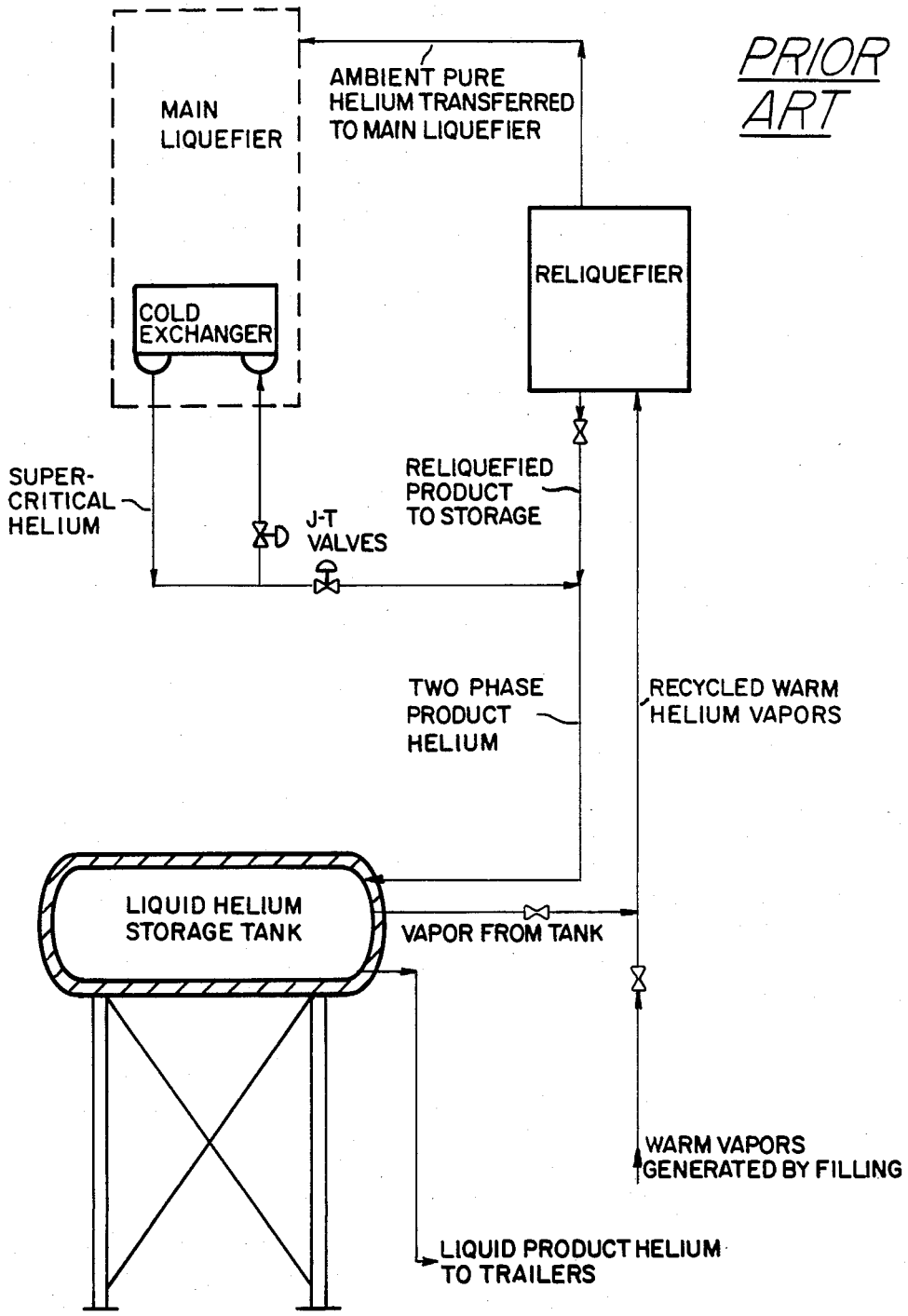
FIG. 1 is a drawing of the prior art method of recycle using a reliquefier.

As shown in FIG. 1, warm vapors generated by either the process or by product loading which are superheated, are fed to a reliquefier. The reliquefier contains a series of heat exchangers and compresion and expansion equipment. The sensible refrigeration of the warm helium vapor is recovered in the reliquefier and a portion, about 80–90%, of the warm vapors are reliquefied and returned to the storage tank. The balance, about 10–20%, of the warm helium vapor is transferred at ambient conditions to the main liquefier unit for liquefaction. The reliquefier can also be used to make the main liquefier independent of the storage tank associated with the liquefier by operating the reliquefier to process storage tank vapors, in addition to the warm vapors generated by either the process or product loading. Storage tank upsets therefore have little effect, if any, on the operation of the main liquefier. Nevertheless, there is a capital and energy penalty in having a reliquefier since extra equipment, e.g. exchangers, compressors, and turbines, must be added. Although the size of the liquefier is decreased marginally, efficiency is impaired because of duplicate and less efficient machinery.

Embodiment 1

Figure 2:
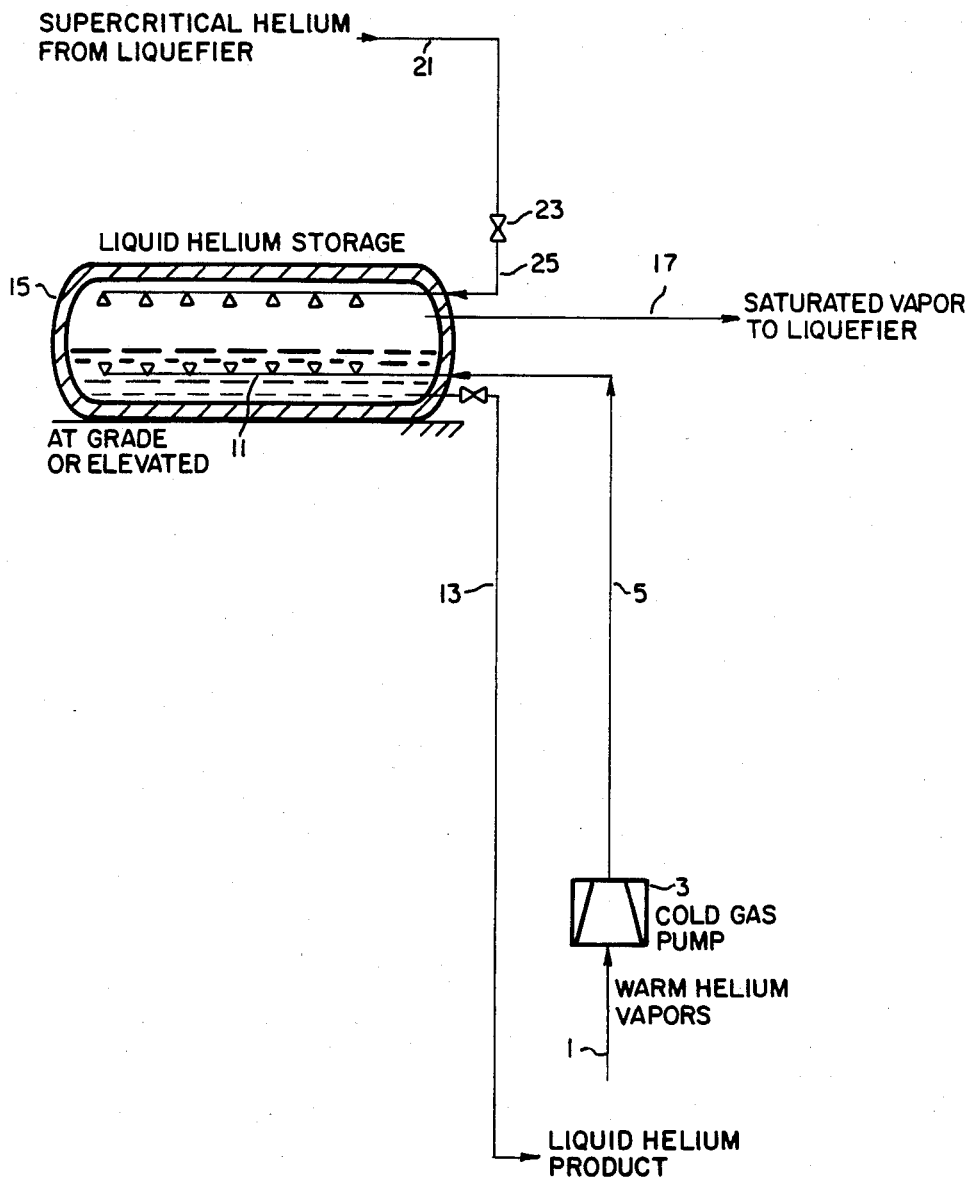
FIG. 2 is a drawing of the present invention in one of the preferred embodiments, which utilizes a cold pump to pump the warm vapors through a pool of liquid in the main storage tank prior to recycling them to the main liquefier.

In the first embodiment, FIG. 2, warm helium vapors, stream 1, from as an example a trailer loading area, are returned to the helium storage tank 15 for injection under the liquid level. In the event that the pressure of the warm helium is not sufficient to return the vapors to the tank, a cold gas pump 3, is used to compress the vapors to a pressure greater than the sum of the equilibrium pressure of helium storage tank 15, the pressure drop from the spargers 11 and associated lines, and the liquid head. The heat input due to the pump 3 is small.

The pressurized warm returning vapor, stream 5, is then injected, by spargers 11 under the level of the saturated liquid in the tank to ensure good contact and mixing with the liquid. As a result of this contact, saturated vapors are produced in the overhead space of tank 15. These vapors along with vapors from stream 25, a two phase mixture, which also contains the bulk helium liquid that is stored in tank 15 that are produced by the throttling, through Joule-Thomson valve 23, of the supercritical helium from the liquefier, stream 21, are withdrawn and returned to the cold end of the helium liquefier, as stream 17.

Embodiment 2

Figure 3:
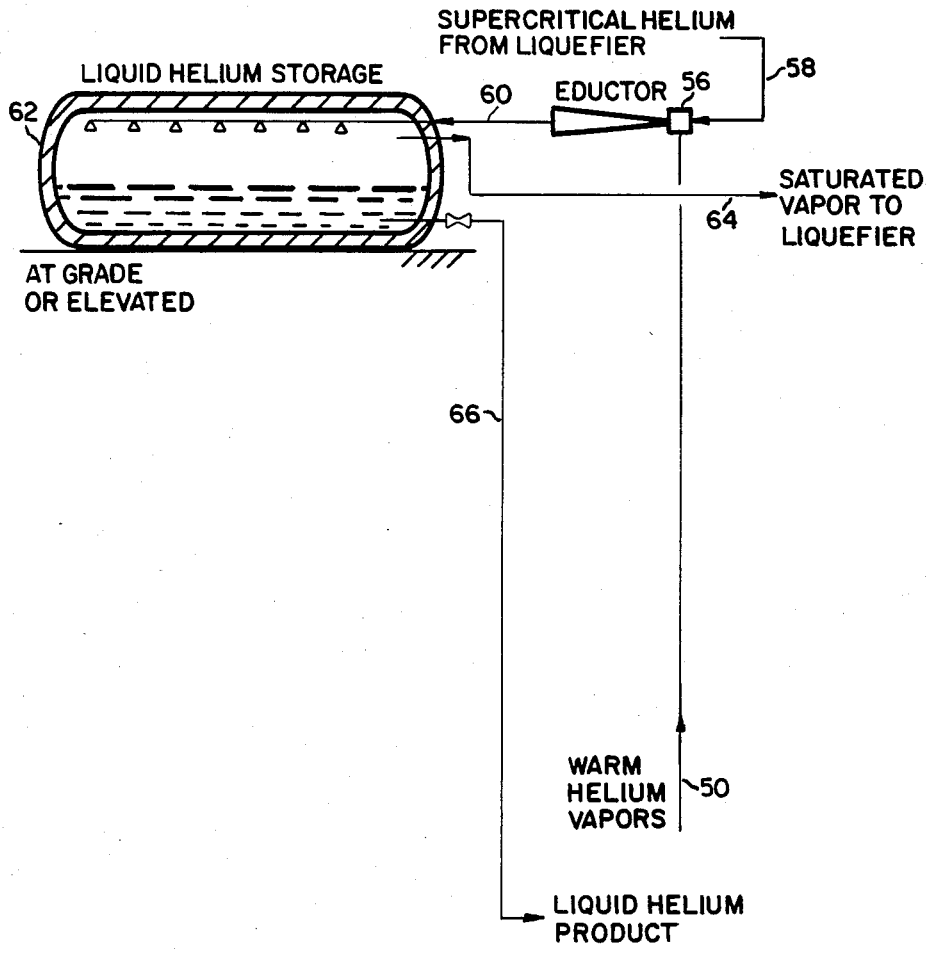
FIG. 3 is a drawing of the present invention in one of the preferred embodiments, which utilizes an eductor to mix the warm vapors with supercritical fluid from the liquefier and returns it to the main storage tank prior to recycling them to the main liquefier.

In the second embodiment, FIG. 3, the warm helium vapors, stream 50, are returned to the storage tank 62 by eductor 56 not pressurization. The supercritical helium from the liquefier, stream 58, is reduced in eductor 56 in order to raise the pressure of the warm helium, stream 50, to storage tank pressure. Good mixing of the cold two-phase helium and returning warm helium vapors is also accomplished in the turbulent interior of the eductor 56. As a result of the eduction and mixing, a two-phase stream, stream 60, richer in vapor than normal, is generated and is then sent to the storage tank. The saturated vapors, are withdrawn from the vapor space in the storage tank and recycled to the cold end of the liquefier, stream 64. Saturated liquid from stream 60 collects in the storage tank and is transferred periodically by means of line 66 to the liquid trailers.

Embodiment 3

Figure 4:
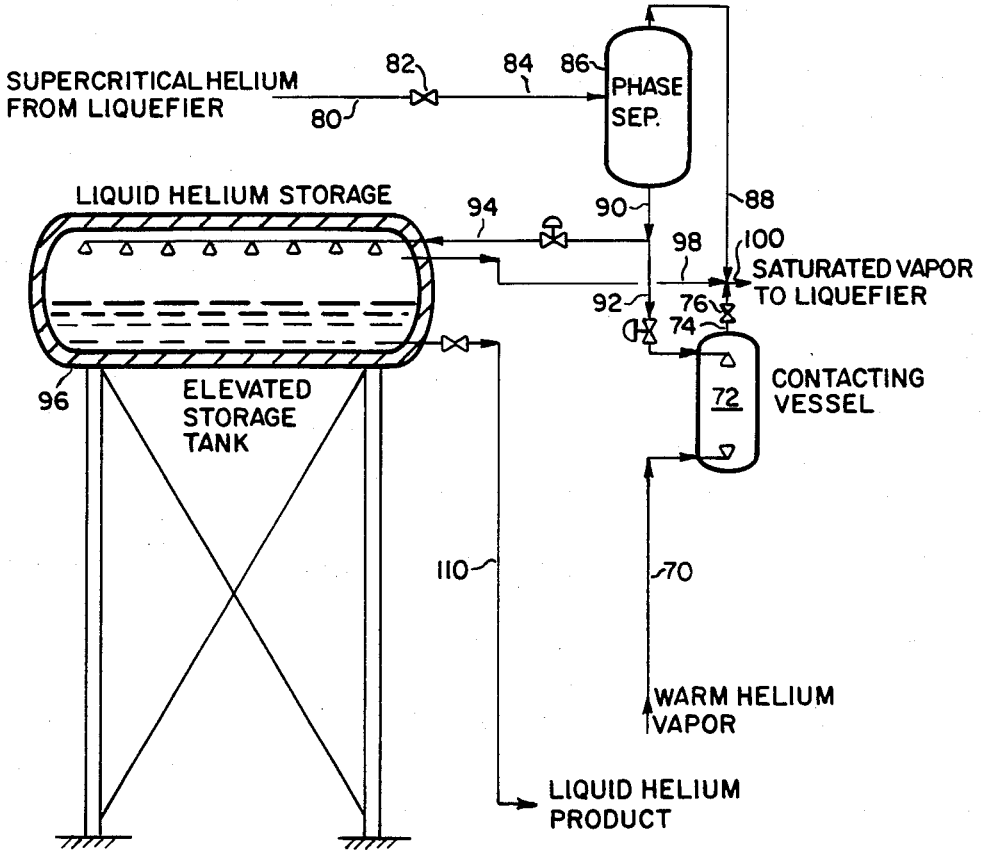
FIG. 4 is a drawing of the present invention in one of the preferred embodiments, which utilizes a contactor to mix the warm vapor with a portion of the liquefied gas prior to recycling the warm vapors to the main liquefier.

In this embodiment another method of contacting the returning warm helium vapors with cold liquid helium without including the main storage tank is described. As shown in FIG. 4, the warm helium vapors, stream 70, from the filling area are returned to contactor 72 and contacted with liquid helium, stream 92. The contactor 72 is used primarily as a direct contact exchange unit. The saturated vapors generated by the heat exchange, stream 74, are combined with vapor stream 98, from storage tank 96 and vapor stream 88 from phase separator 86. The total mixture, stream 100, is sent to the cold end of the liquefier. Liquid for the contacting tower is taken from phase separator 86 following throttling of the supercritical helium from the liquefier, stream 80, in Joule-Thomson valve 82. Part of the liquid from phase separator 86, stream 90, is sent to storage as stream 94 while the balance is sent to tower 72 as wash liquid, stream 92. Periodically liquid from the storage tank is transferred, in line 110, to the liquid trailers.

It is important to note that storage tank 96 in this embodiment must be elevated sufficiently so as to provide a pressure driving force to recycle the warm helium, stream 70, back to the liquefier.

Although not intending to be bound by any particular theory, this invention solves the problem by ensuring that the warm, uncertain condition of the returning helium vapors, from trailer loading, is reduced to a saturated, essentially constant enthalpy condition prior to recycle to the main liquefier.

As a result of the essentially constant enthalpy condition, liquefier operation and control is enhanced and production upsets do not occur. The liquefier design can readily handle and accept this constant condition and the impact on expanders, compressors and exchangers is minimized. For instance, if the warm helium vapors are returned as generated, overspeed on expander and super or sub-atmospheric pressures on the compressor suction could lead to production upsets and losses in capacity. However, with a essentially constant enthalpy condition of the recycled vapors, liquefied operation will be stable because such condition can be anticipated and accommodated in the design, so that full production capacity can be maintained. This will also ensure that the upstream equipment supplying fresh helium to the liquefier can run at constant rates.

The present invention has been described with reference to several preferred embodiments thereof. However, these embodiments should not be considered a limitation on the scope of the invention, which scope should be ascertained by the following claims.

We claim:

1. In a process for the liquefaction of a cryogen, said cryogen being selected from a group consisting of hydrogen, helium, and neon, wherein unsaturated vapors are recycled to a liquefier, the improvement comprising:

(a) contacting the unsaturated vapors of said cryogen with the same cryogen in the liquid phase, to produce a saturated, essentially constant enthalpy vapor stream; and (b) recycling said saturated, essentially constant enthalpy vapor stream back to the liquefier.

2. The process of claim 1 wherein said contacting is accomplished by cold pumping said unsaturated vapors through spargers located under a level of saturated liquid in a storage tank associated with said liquefier to ensure good contact and mixing with the liquid.

3. The process of claim 2 wherein said cryogen is helium.

4. The process of claim 1 wherein said contacting is accomplished by mixing said unsaturated vapors with supercritical fluid from the liquefier in an eductor.

5. The process of claim 4 wherein said cryogen is helium.

6. The process of claim 1 wherein said contacting is accomplished by mixing said unsaturated vapors in a contacting tower with cold saturated liquefied cryogen.

7. The process of claim 6 wherein said cryogen is helium.

8. The process of claim 1 wherein said cryogen is helium.

9. The process of claim 1 wherein said cryogen is hydrogen.

10. The process of claim 1 wherein said cryogen is neon.

* * * * *